United States Patent [19]

Vacca

[11] 4,274,784

[45] Jun. 23, 1981

[54] CUPOLA CHARGING

[75] Inventor: Philip J. Vacca, Blue Island, Ill.

[73] Assignee: Whiting Corporation, Harvey, Ill.

[21] Appl. No.: 44,092

[22] Filed: May 31, 1979

[51] Int. Cl.[3] ..... F27D 3/12

[52] U.S. Cl. ..... 414/168; 414/173; 414/178

[58] Field of Search ..... 414/168, 169, 170, 172, 414/173, 178, 192, 598, 639, 644, 657, 658, 21; 266/183, 900, 901

[56] References Cited

U.S. PATENT DOCUMENTS

| | | | |
|---|---|---|---|
| 336,749 | 2/1886 | Rotthoff | 414/168 |
| 926,357 | 6/1909 | Roe | 414/168 |
| 2,693,887 | 11/1954 | Davel | 414/178 |
| 3,097,711 | 7/1963 | Clark | 414/21 X |
| 3,214,035 | 10/1965 | Krause et al. | 414/173 |
| 3,502,233 | 3/1970 | Mevissen et al. | 414/173 |
| 3,756,430 | 9/1973 | Vandril | 414/173 |

*Primary Examiner*—James L. Rowland

*Attorney, Agent, or Firm*—Lockwood, Dewey, Alex & Cummings

[57] ABSTRACT

A cupola installation having a top charging opening and a vibratory feeder mounted to discharge into the top opening from one side. The skiphoist associated with the cupola carries two charging buckets, one for discharging charge material into the top charging opening in the stack while the other is for simultaneously discharging material into the pan or hopper of the vibratory feeder. When the empty charging buckets are lowered, the vibratory feeder is operated to discharge its load into the top charging opening. The use of two charging buckets permits a charge material of a type not suitable for charging along with the main charging material, to be separately charged in a gentler manner. For example, briquettes of cast iron borings and chips or of steel turnings are easily broken into objectionable fines when handled and charged in a conventional manner. Cooperating equipment associated with the trim platform assists in the loading of charge material into the separate charging buckets. The invention resides both in the novel charging apparatus and the novel method of charging material into the cupola.

6 Claims, 8 Drawing Figures

7
8
11
13
15
16
32
33
34
35
36
37
38
40
41
42
43
44
45
46
1
2
3
4
5

CUPOLA CHARGING

This invention relates generally to innovations and improvements in cupola installations including apparatus and methods of operating the same with the primary object thereof to provide novel means and method whereby charging material of a nature which preferably should be handled separately from the main charge for the cupola can be efficiently and conveniently handled separately without interferring with or detracting from normal cupola operation.

Cupola installations are well-known and comprise a cupola proper with either a top charge opening in the stack or a side charge opening in the side of the stack and an associate skiphoist having a single charging bucket which shuttles between a bottom loading station and an upper discharging station. A preferred form of cupola installation having a side charge opening is shown and described in connection with U.S. Pat. No. 3,756,430 dated Sept. 4, 1973. Top charge opening cupola installations are well-known and normally include a drop bottom charging bucket mounted on the skiphoist which on being positioned directly over the top opening in the cupola stack discharges through the bottom directly into the stack. Conventional charging materials include scrap metal, coke, and limestone. In addition, it has become increasingly the practice to incorporate in the charge additional materials, such as briquettes of iron borings and chips or steel turnings, alloys, etc.

In known cupola installations, the charging materials are subjected to relatively rough handling treatment both in the loading operation at the bottom of the skiphoist and in the discharging or dropping of the charge into the cupola at the top of the skiphoist. For example, the charging materials are ordinarily dropped substantial distances both in the bucket loading operation and in the charging operation at the top of the cupola. Such relatively rough handling leads to problems and difficulties, particularly in connection with certain charging materials which are not suited to be handled in this manner.

By way of illustration, briquettes of cast iron borings and chips or of steel turnings are representative of charge materials that could materially benefit from handling separate and apart from the normal charging materials such as scrap, limestone and coke. Accordingly, the following description will focus on such briquettes but it will be understood that the same are only representative of other materials of a similar nature, or of a nature creating similar problems when handled in a conventional manner.

Many foundries find briquettes of cast iron borings and chips or of steel turnings to be an economically attractive charge material for melting in a cupola. Some foundries use as much as 60% briquettes in a cupola charge. However, a problem associated with such briquettes is the fact that they are easily broken with the production of fines. Breakage reduces the yield of the briquetting operation and increases the cost of the briquettes that are eventually charged into the cupola. Accordingly, it is important that equipment for handling briquettes be designed and procedures developed, to reduce breakage at all stages of handling.

As a practical matter, some fines will be produced in handling briquettes but the fines should not be charged into the cupola but should be separated prior to being weighed as part of the cupola charge. However, such breakage of the briquettes and production of fines that occurs after the briquettes have been weighed and during the actual charging operation can cause serious operation problems in the cupola. Thus, briquette fines tend to fill or plug the voids in the charge and thereby restrict the free flow of cupola gas. This results in increased back pressure which in turn results in the need for higher pressure blowers and additional horsepower. Reduction in the output of the blower due to increased back pressure causes a reduction in the melting rate of the cupola and production falls off. Furthermore, briquette fines may be carried out of the cupola by high velocity cupola gas and transported into the gas cleaning system. This can cause plugging of the gas cleaning system, erosion of the ductwork, etc. It also increases the cost of the cleaning system as additional measures must be taken to handle the fines.

Briquette fines introduced into the cupola can also participate in the formation of so-called "skull" in the cupola. This takes the form of a crust formation at the top of the melt zone. Uncontrolled skulling can result in shutdown of the melting operation.

As previously indicated, normal or conventional methods and apparatus of and for charging materials into a cupola, do not give the gentle handling of briquettes that is required to minimize breakage and avoid formation of substantial quantities of fines. A typical charging system consists of a trim platform with weigh-hopper for preparing metal charges, and a skiphoist with a drop bottom bucket for charging the materials into the cupola. A magnet crane drops metallics into the weigh-hopper. This hopper is generally sized to handle the desired weight of charge material having the lowest anticipated bulk density, plus a top allowance or free board space. When relatively high density briquettes are charged into the conventional oversize weigh-hopper the drop distance from the magnet is much greater than necessary causing breakage and fines production. Likewise, the conventional charging buckets are normally sized for low density scrap and thus oversized for a charge containing a high percentage of briquettes resulting in additional breakage and fines production.

In addition to the foregoing considerations, the placement and distribution of briquettes in a cupola are also important. Thus, the conventional drop bottom charge bucket places the charge material primarily in the center of the cupola. This causes the center of the charge to be more tightly packed than the portions of the charge adjacent the wall of the cupola. The tightly packed center promotes channeling of gas at the wall of the cupola which reduces the efficiency of the cupola and can result in overheating the shell causing it to crack or buckle, thereby necessitating shutdown for expensive repair and loss of production.

In view of the foregoing, the object of the present invention, generally stated, is the provision of novel apparatus for and method of handling briquettes or other components of a cupola charge so as to minimize problems related to charging briquettes and other materials in the normal manner along with conventional main charge components.

A further important object of the invention is to provide such apparatus and method which will not appreciably interfere with, but preferably enhance, the efficiency of the loading and charging operations associated with the operation of a cupola.

Still a further important object of the invention is to provide such apparatus and method which minimizes the requirement for specialized equipment not already available and maximizes the use of conventional equipment.

Certain other objects of the invention will be obvious from the following detailed description thereof taken in connection with the accompanying drawings, wherein.

Figure 1:
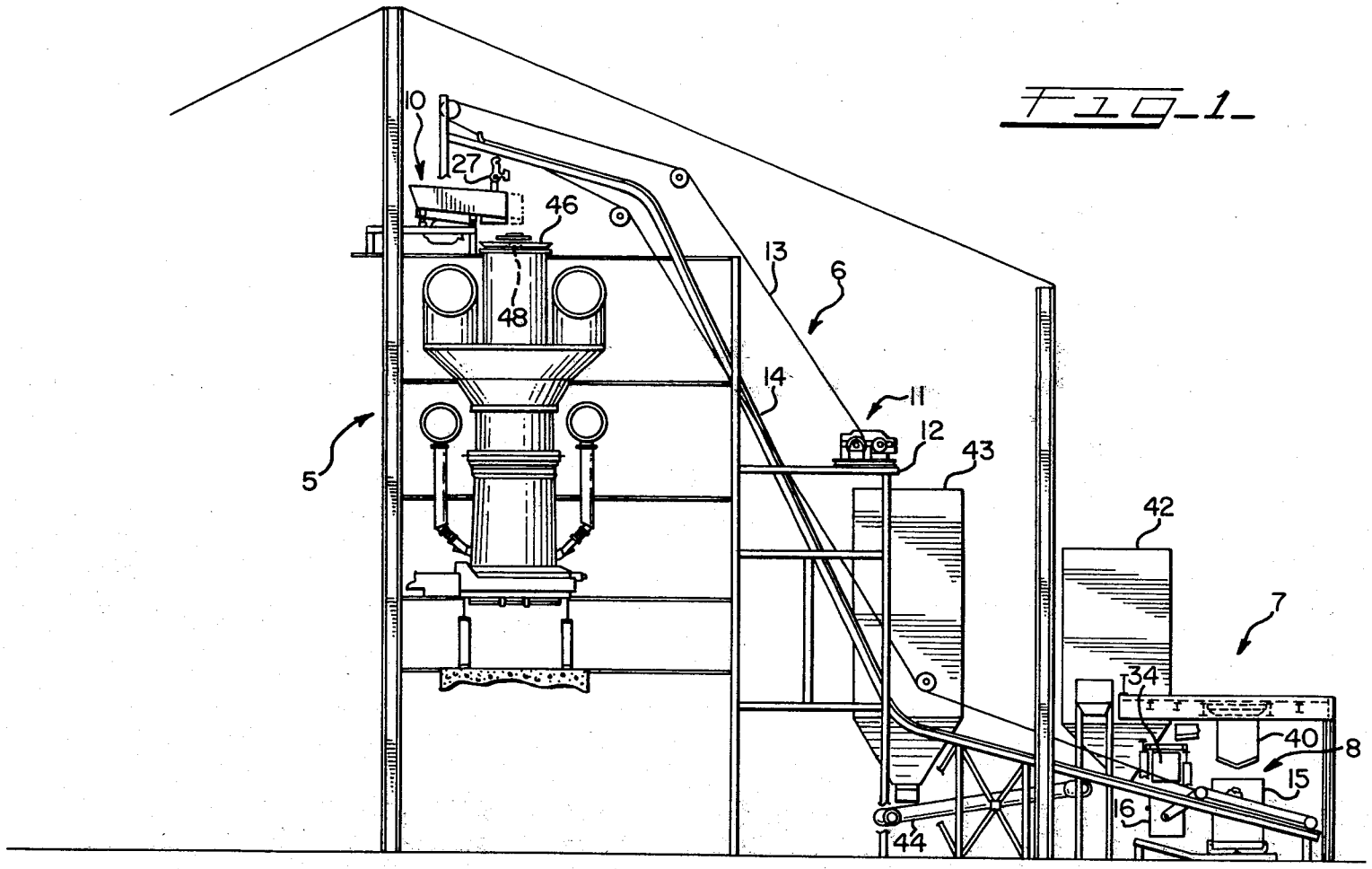
FIG. 1 is a side elevational view of a cupola installation wherein the cupola stack has a top charge opening and the installation includes apparatus made and operable in accordance with the present invention.

Referring to FIG. 1, a cupola is indicated generally at 5 having a top charging opening of known or conventional design. The skiphoist associated with the cupola 5 is indicated generally at 6 with the trim platform and associated weighing and charging apparatus indicated generally at 7. The skip having two charging buckets in accordance with the present invention is indicated generally at 8 and a retractable vibratory feeder mounted at the top of the cupola and to one side of the top opening therein is indicated generally at 10.

As is well understood, the skip 8 shuttles or operates between a lower or bottom charge-loading position at the trim platform 7 and an upper or top discharging position over the top of the cupola 5. In accordance with conventional cupola installations, the skip 8 is operated by means of a powered winch unit 11 of known type mounted on a suitable superstructure which includes a platform 12. A pair of cables 13 and two sets of sheaves or pulleys therefor are appropriately located in known manner so as to raise and lower the skip 8. Each cable 13 is anchored at one end to one side of skip 8 while the opposite end portion of the cable is wound on the appropriate drum of the winch unit 11. In operation, the winch 11 is driven in one direction so as to wind up the cables 13 on their respective drums and thereby cause the skip 8 to ride the side rails 14—14 of the skiphoist up to its upper position over the top of the cupola. The upper end of the tracks are inclined so that when the winch 11 is reversed, the skip 8 will automatically under its own weight lower itself under the controlled braking action of the winch to its bottom position at the trim platform 7.

The skip 8 is of novel and unique construction in that it has two charging buckets instead of the usual single charging bucket. One of the charging buckets, which is generally utilized to handle the primary charge material, is designated at 15 and is of the conventional drop bottom type. The other bucket is of the side dump type and is indicated at 16, being generally used to handle smaller quantities of other charge materials and, particularly, charge material components that benefit from substantially gentler than normal handling, such as briquettes.

Figure 8:
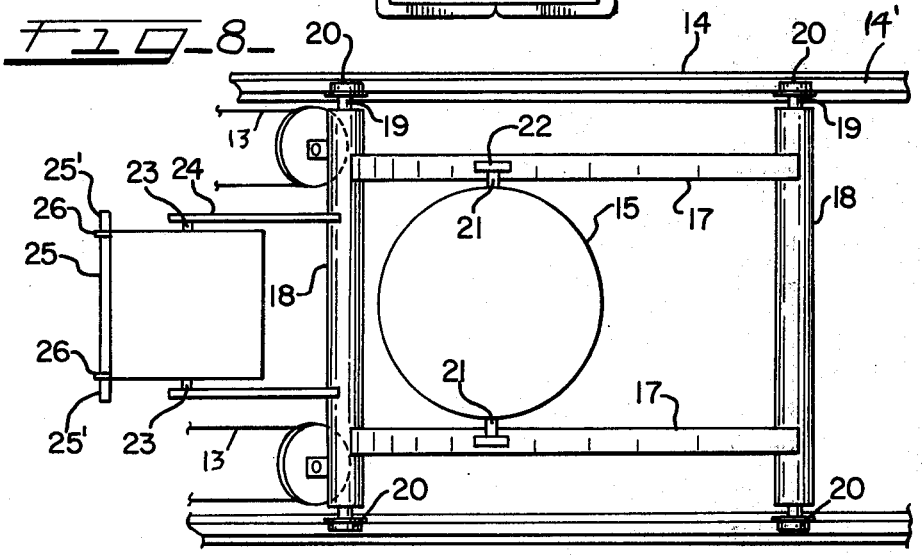
FIG. 8 is a top plan view taken on line 8—8 of FIG. 7.

The skip 8 (FIG. 8) comprises a frame which includes a pair of parallel side members 17—17 interconnected at their front and rear ends by cross-members 18—18 which may take the form of a length of pipe. The cross-members 18 have projecting from their opposite ends spindles 19 carrying flanged wheels 20—20 which ride rails 14'—14' mounted on the side rails 14 in known manner. The drop bottom bucket 15 has a pair of trunnions 21—21 projecting from opposite sides which project into journal openings provided therefor in upstanding ears 22—22 mounted on the tops of the side members 17. It will be seen that the pivotal mounting of the bucket 15 on the trunnions 21 is located well above the center of gravity of the bucket 15 whether loaded or empty.

The smaller side dump bucket 16 also has a pair of trunnions 23—23 projecting from opposite sides thereof which project into journal openings provided therefor on the lower forward ends of a pair of arms 24—24 projecting in cantilever fashion from the front or upper cross-member 18. The bucket 16 is so constructed and weighted that the trunnions 23 are located above the center of gravity of the bucket but relatively close thereto when loaded so as to facilitate the tilting thereof.

On the front side of the bucket 16 in its upright position, a rod 25 is mounted in a pair of ears 26—26 with the opposite ends 25'—25' of the rod 25 projecting beyond the respective sides of the bucket being machined so as to form tilt trunnions. The purpose of the tilt trunnions 25' is to cooperate with a pair of weighted tilt hooks 27—27 (FIGS. 1 and 4) mounted on the upper ends of upstanding supports 28—28 adjacent the lower end of the pan or hopper 30 of the retractable vibratory feeder 10. The tilt hooks 27 are pivoted on the supports 28 and include counterweights 31 which normally maintain them in the position shown in FIG. 1 in readiness for engaging the tilt trunnions 25' as the bucket 16 approaches its uppermost position. The trunnions 25' engage the tilt hooks 27 tangentially so that there is no appreciable impact and the following dumping action is smooth. Each hook 27 exerts a force on a trunnion 25' that acts through the center of the hook pivot bearing. This force prevents the trunnion 25' from escaping the hook 27 except at the entry point where its travel is perpendicular to the force. This same force causes the tilt hooks to return to the upright position when the skip 8 descends. The counterweights on the hooks 27 keep the hooks in their upright position for the next cycle.

Figures 2, 3:
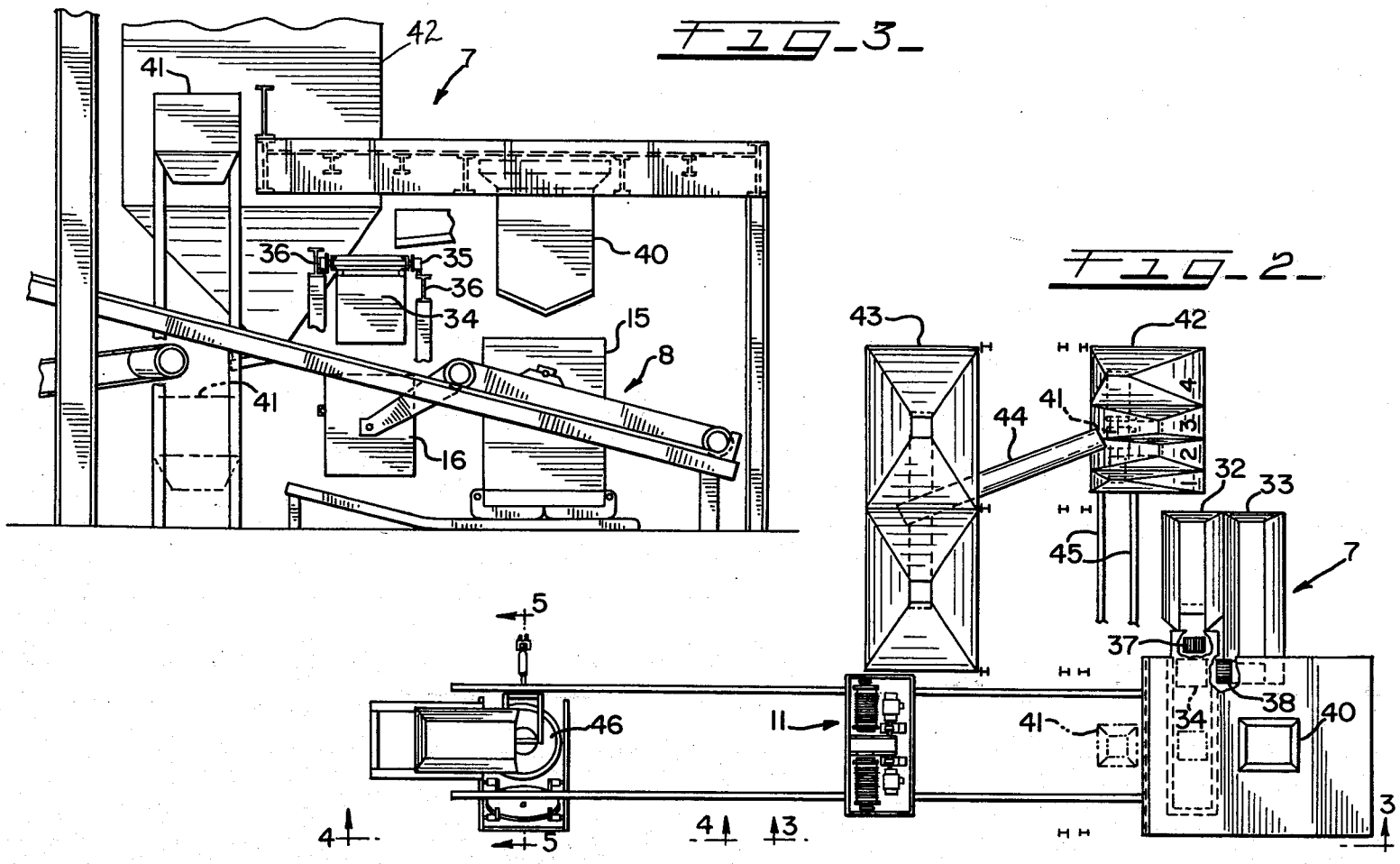
FIG. 2 is a top plan view of the installation shown in FIG. 1.
FIG. 3 is a fragmentary elevational view on enlarged scale of the lower portion of the installation with certain parts omitted, and taken in line 3—3 of FIG. 2.

In view of the fact that the skip 8 has two charge buckets, the equipment associated with the trim platform 7 is of novel design and operation, as will appear from a description thereof in connection with FIGS. 2 and 3. At the trim platform 7, there are a pair of apron conveyors or vibratory conveyors 32 and 33 which serve to feed charge material that benefits from gentle handling, such as briquettes, to a weigh hopper 34 which is provided with pairs of wheels 35—35 (FIG. 3) adjacent the top so as to ride on rails 36—36 between a retracted position underneath the delivery ends of the apron conveyors 32 and 33 and an advanced position centered over the charge bucket 16 in its lowermost load or charge-receiving position. As will be seen from FIG. 2, each of the delivery chute ends of the apron conveyors 32 and 33 is provided with a grizzly section 37 and 38, respectively, for the removal of fines just before the material such as briquettes is discharged to the weigh hopper 34 in its retracted position.

The weigh hopper for receiving primary charge materials for the drop bottom bucket 15 is indicated at 40. Materials such as scrap iron and other charge materials that withstand dropping a substantial distance can be loaded into this relatively large weigh hopper 40 and then, in turn, dropped into the drop bottom charge bucket 15.

A second weigh hopper 41 operates between a lowered position underneath one side of a multi-compartment bin 42 and an elevated position centered between the skip hoist rails 14. In its lowered position, the weigh hopper 41 can receive charge materials from any one of four separate compartments into which bin 42 is divided as well as material from a larger hopper bin 43. A conveyor 44 of known type may be used to elevate material from the bottom of the bin 43 so as to discharge it into the weigh hopper 41 in its lowered position. The weigh hopper 41 rides in known manner on a pair of inclined tracks 45.

Moving from the trim platform 7 to the upper end of the skip hoist 6 and the top of the cupola 5, the top charge opening of the cupola is indicated at 46. The retractable vibratory feeder 10 is suitably mounted on a platform 47 on the side of the top charge opening 46 opposite from the skip hoist 6. The vibratory feed 10 is of known type and may conform, in construction and operation, to the vibratory or shaking feeder 12 in Van Dril U.S. Pat. No. 3,756,430.

Figure 4:
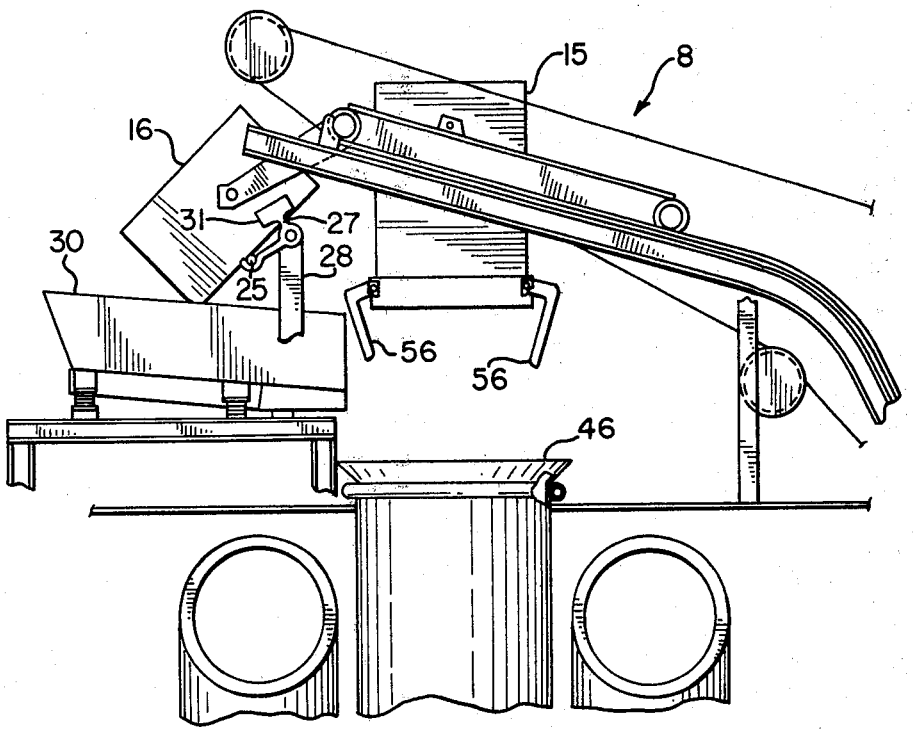
FIG. 4 is a fragmentary side elevational view on enlarged scale of the upper portion of the installation with certain parts omitted and taken on line 4—4 of FIG. 2.
Figure 6:
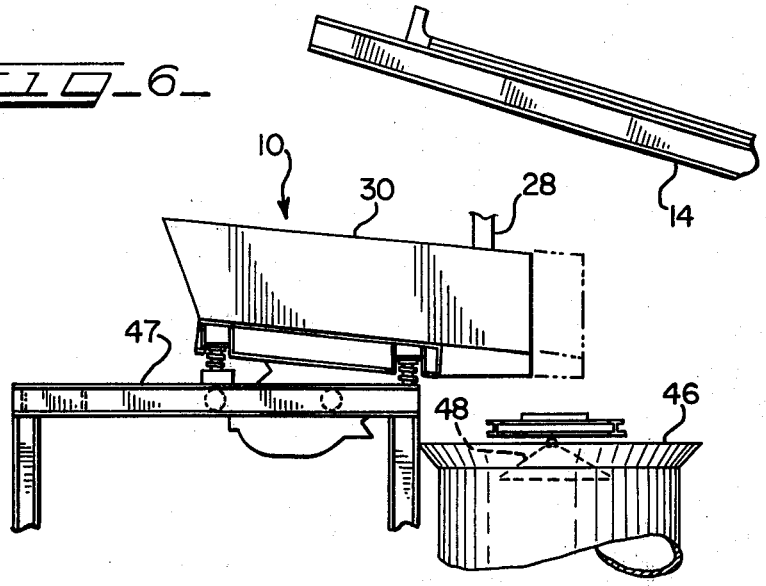
FIG. 6 is a fragmentary side elevational view on an enlarged scale corresponding to FIG. 4 with parts removed showing the retracted and advanced discharging positions of the vibratory feed hopper associated with the upper end of the cupola stack.
Figure 7:
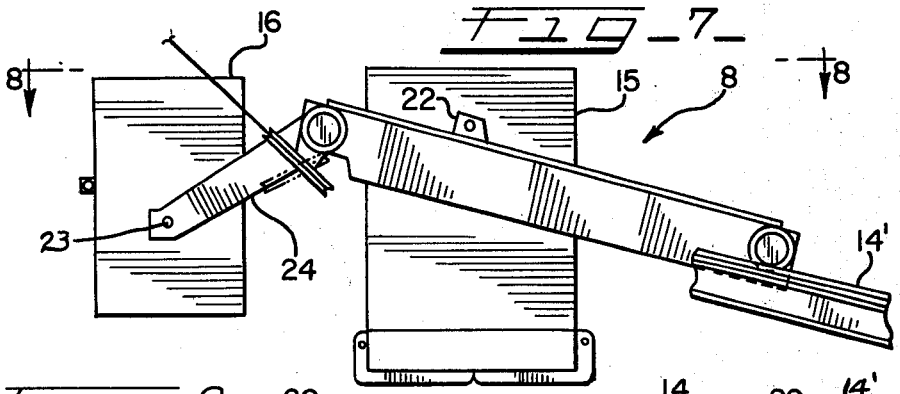
FIG. 7 is a fragmentary side elevational view showing the two charge buckets of the skiphoist in their upright positions.

Since the feeder 10 is of known construction, it will suffice to point out that the feeder 10 has a pan or hopper 30 and can be moved between a retracted position as shown in FIG. 4 and a feeding or discharging position as shown in FIGS. 1 and 6. Even when the pan 30 is in its most retracted position, the lower lip of the pan should slightly overhang the adjacent side of the top charge opening 46 so that loose material falling prematurely from the pan will fall into the opening 46. In its advanced position the lower discharge lip of the pan 30 oscillates over the center of the top opening 46 as indicated in broken line in FIG. 6.

Figure 5:
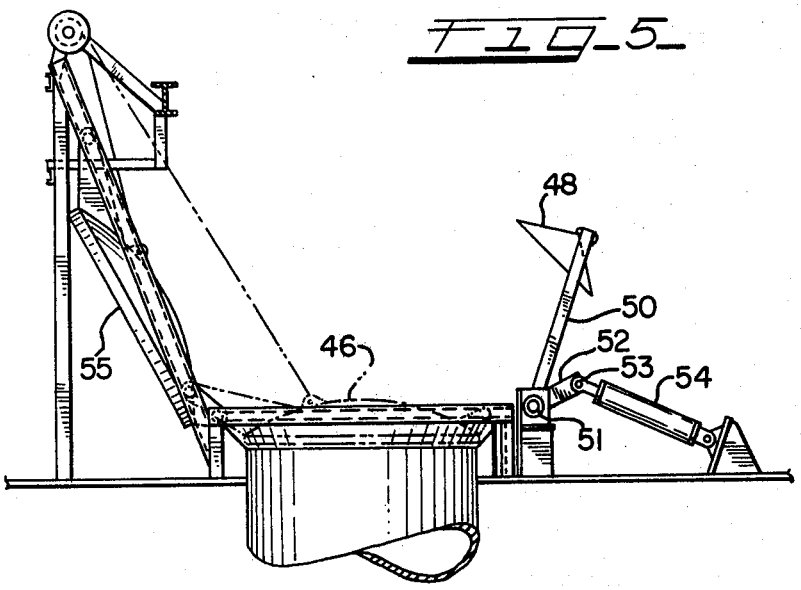
FIG. 5 is a fragmentary elevational view taken on line 5—5 of FIG. 2 on somewhat enlarged scale and with certain parts removed showing the charge-receiving condition of the installation at the upper end of the cupola stack.

In many instances, it is desirable that the charge material dropped into the top charge opening 46 be spread toward the sides of the cupola stack and away from the center thereof. It is known to provide a distributor or spreader cone for this purpose and one such cone is indicated at 48 in FIGS. 1, 5 and 6. The cone 48 is pivotally suspended from the distal end of an arm 50 with the opposite end thereof being connected to a rock shaft 51. A crank arm 52 is also connected to the rock shaft 51 and pivotally connected at 53 to the piston rod of a hydraulic or air cylinder 54. Upon actuation of the cylinder 54, it will be seen that the spreader cone 48 can be swung between its upper, outer position as shown in FIG. 5 and its lower, inner position in the center of the top charge opening 46, as shown in FIGS. 1 and 6. It will be seen that the spreader cone 48 is so mounted and operated that its operation does not interfere with the vibratory feeder 10.

Preferably, the cupola installation 5 is also provided with a burn-down cap 55 (FIG. 5) which is mounted in known manner, forming no part of the present invention, so it can be moved between the position shown in solid line where it is lifted off and retracted from the top opening 46 and the position shown in broken line where it is resting on and closing the top opening 46.

In operation, a magnet crane will conventionally be used to load charge materials such as scrap and iron briquettes while non-magnetic charge materials such as limestone, coal, coke, etc. are otherwise suitably handled. The appropriate charge materials, such as scrap, pig iron, etc., are first weighed into the larger weigh hopper 40 and then the bottom thereof is opened and the charge is dropped into the drop bottom bucket 15.

A magnet crane can also be used for lowering briquettes formed of cast iron borings and chips or of steel turnings onto one or both of the aprons of the apron conveyors 32 and 33. Some fines will be present or produced and will be removed through the grizzly sections 37 and 38 before the briquettes are discharged into the weigh hopper 34. The latter is closely adjacent the discharge ends of the conveyors 32 and 33 so that the briquettes will fall only a short distance into the relatively shallow weigh hopper 34. The weigh hopper is arranged to travel from the conveyor area to a position over the bucket 16 in order to discharge its contents and then returns to the conveyor area in order to provide clearance for the skip 8 to travel to the top of the cupola. The charge from the weigh hopper 34 will then be dropped into the side dump bucket 16, falling only a relatively short distance in being dropped. Coke, stone and alloy are a part of each normal charge.

After the loading operation has been thus performed, coke, stone and alloy will be introduced into either the drop bottom bucket 15 or side dump bucket 16 and this is accomplished by advancing the skip 8 until the appropriate one of these buckets is brought under the weigh hopper 41. Typically, the storage bin 43 will have one or two coke compartments and one stone compartment. It will be understood that this arrangement may vary in both size and number for particular installations. The appropriate charge material is introduced into the weigh hopper 41 in its lowered position and then it is transported up and positioned over one of the charge buckets 15 or 16 and dropped thereinto. All or a portion of the charge materials may be introduced into one of the charge buckets 15 or 16 in this manner.

With the buckets 15 and 16 thus loaded, the skip 8 is elevated by means of the winch 11 to the top of the skip hoist. As the skip 8 approaches its upmost position, the tilt trunnions 25' on the front of the bucket 16 will engage the upstanding tilt hooks 27 and thereby initiate tilting of the bucket 16 in a counterclockwise direction as viewed in FIG. 4. By the time that the drop bottom bucket 15 is centered directly over the top charge opening 46, the charge bucket 16 will be in its fully tilted position discharging its contents into the pan 30 of the feeder 10. With the charge bucket 15 located directly over the opening 46, the bottom doors 56 on the bucket 15 are opened down and outwardly dropping the charge into the charge opening 46. When the charge has been thus dropped, the contents of the charge bucket 16 will also have been discharged into the pan 30 and the skip 8 may now be lowered, without delay, back to the trim platform 7 for reloading the buckets 15 and 16.

During this retraction movement, the bucket 16 will right itself and the hooks 27 will return to their normal upright position in readiness for again engaging the tilt trunnions 25' on the next or return arrival of the skip 8.

After the skip 8 has been retracted or lowered sufficiently so that the tilt hooks 27 are no longer in engagement with the tilt trunnions 25', the feeder 10 is shifted to its forward or advanced position over the center of the charge opening 46 and with the assistance of vibration and the oscillation of the feeder, the contents are distributed over or into the opening 46. At the discretion of the operator, after the charge is dropped from bucket 15, the distributor cone 48 may be put in place in the opening 46 before the vibratory feeder 10 is advanced to its discharging position.

While the specific installation shown in the drawings and described above is flexible and will be suitable for a variety of cupola operations, it will be readily appreciated by those skilled in the art that a number of modifications can be made without departing from the spirit and scope of the invention in its broader sense. Certain of these will be mentioned by way of illustration.

The side dump bucket can be replaced with either a second drop bottom bucket or with a hydraulic cone bottom bucket of known commercial type, thereby eliminating the vibratory feeder 10 and the distribution cone 48. With this modification, the operator stops the skip 8 so as to drop the charge of one charge bucket into the top opening 46 and then moves the skip so that the second charge bucket will be positioned over the opening 46.

The important point is that a two-bucket skip permits separation of charge materials, the use of smaller charge buckets, and the use of specialized buckets best suited to handling the materials being charged and distributing them in the cupola in a way that gives best efficiency.

Changes may be made in the weighing and charging apparatus 7. For example, the weigh hopper 41 can be eliminated with reliance on weigh hoppers 34 and 40 and suitable rearrangement in equipment to deliver materials to these hoppers.

Other changes of a detail nature may be made such as eliminating the rod 25 on the front side of the bucket 16 and the tilt trunnions mounted in the ears 26 so as to be replaceable and rotating, or permanently welded to the bucket 16 and non-rotating.

What is claimed as new is:

1. In combination with a cupola installation including a skiphoist and wherein the stack of the cupola has a top charging opening and a retractable feeder having a charge-receiving pan is mounted on one side of the stack for shifting over and discharging material into said top opening, a skip operative on said skiphoist between a bottom charge-loading position and a top charge-discharging position and comprising, a carriage and two charging buckets mounted thereon, in said top position a first of said buckets being in load discharging position over said stack top opening and the second of said buckets being in load discharging position over said charge-receiving pan of said retractable feeder, and actuating means operative for concurrently discharging the contents of said first and second buckets into said stack top openings and said charge-receiving pan, respectively.

2. In the combination called for in claim 1 said first charging bucket being a drop bottom bucket and said second charging bucket being a side dump bucket.

3. In the combination as called for in claim 2 said actuating means including means for tilting said second side dump charging bucket as said first drop bottom bucket approaches a position directly over said stack top opening and for putting said second side dump charging bucket into its fully tilted discharging position when said first drop bottom bucket is positioned directly over said stack top opening.

4. In the combination called for in claim 3 said retractable feeder being aligned with said skiphoist and on the opposite side of said cupola from said skiphoist.

5. The method of charging a cupola having a top charging opening and a retractable feeder mounted to one side thereof with primary charge material and also with secondary charge material, which comprises, loading the primary charge into a drop bottom bucket, loading the secondary charge into a side dump bucket, elevating on a skiphoist a skip on which said buckets are mounted so as to bring said drop bottom bucket directly over said top charging opening and tilt said side dump bucket into tilted dumping position over the pan of said retractable feeder, dropping the primary charge material through the bottom of said drop bottom bucket into said top charging opening, dumping the secondary charge material out one side of said side dump bucket into the pan of said retractable feeder in its retracted position, lowering said skip on said skiphoist, advancing said retractable feeder over said top charging opening, shaking said secondary charge material into said opening, and retracting said feeder.

6. In the method called for in claim 5 handling said primary charge material in normal manner including dropping said primary charge material normal distances during weighing and loading, and handling said secondary charge material in gentler than normal manner including dropping said charge material substantially shorter than normal distances.

* * * * *